US007330151B1

(12) United States Patent
Monk et al.

(10) Patent No.: US 7,330,151 B1
(45) Date of Patent: Feb. 12, 2008

(54) ALIGNMENT OF AN ELLIPTICAL BEAM OF AN ANTENNA

(75) Inventors: Anthony D. Monk, Seattle, WA (US); Janet King, Redmond, WA (US); Jeffrey D. Miller, Mercer Island, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/614,950

(22) Filed: Dec. 21, 2006

(51) Int. Cl.
*H01Q 3/00* (2006.01)

(52) U.S. Cl. ..... 342/359; 342/354; 342/364

(58) Field of Classification Search ..... 342/359–360, 342/364, 366, 354
See application file for complete search history.

(56) References Cited

U.S. PATENT DOCUMENTS 4,060,808 A * 11/1977 Foldes ..... 342/362
6,052,084 A * 4/2000 Aoshima et al. ..... 342/359
6,107,962 A * 8/2000 Calvert ..... 342/364

* cited by examiner

*Primary Examiner*—Thomas H. Tarcza
*Assistant Examiner*—Fred H. Mull
(74) *Attorney, Agent, or Firm*—Ingrassia Fisher & Lorenz, P.C.

(57) ABSTRACT

A system and methods for aligning an elliptical beam of an antenna to a line-of-sight from the antenna to a remote receiver are disclosed. The methods offset the antenna from an initial pointing direction in an antenna pointing coordinate system. Coordinates of the pointing offsets are determined in the E-plane and H-plane of an antenna beam coordinate system. The method then converts the coordinates of the pointing offsets from the antenna beam coordinate system into coordinates of offset points each located in the antenna pointing coordinate system according to the polarization angle of the E-plane and the H-plane, and performs a tracking algorithm using relative signal strength measurement data at the initial pointing directions and at the coordinates of the offset points. The true location of the center/peak of the elliptical beam is calculated in azimuth/elevation planes of the antenna pointing coordinate system.

20 Claims, 5 Drawing Sheets

ALIGNMENT OF AN ELLIPTICAL BEAM OF AN ANTENNA

TECHNICAL FIELD

Embodiments of the disclosure relate generally to antenna tracking systems. More particularly, embodiments of the disclosure relate to an antenna beam pointing technique.

BACKGROUND

Many ground or mobile antennas transmit an elliptical beam towards a remote receiver such as, without limitation, a satellite or unmanned aerial vehicle (UAV). A direct line from the antenna to the remote receiver is the true line-of-sight from the antenna to the remote receiver. The pointing direction of the antenna is the antenna line-of-sight. The peak signal power of the elliptical beam will point in the direction of the antenna line-of-sight, but the antenna line-of-sight may or may not be pointed on the true line-of-sight, and may be off a few degrees. Here, whatever direction an antenna is pointing in before a process starts is referred to as the initial pointing direction, which may or may not be the true line-of-sight to the remote receiver.

Step track is a widely-used technique which allows an antenna to be pointed accurately at a remote receiver, so that antenna line-of-sight and hence the peak signal power of the elliptical beam is closely aligned with the true line-of-sight from the antenna to the remote receiver. A received signal strength indicator is returned from the remote receiver to indicate the strength of the signal power of the elliptical beam. Step track works by measuring the relative strength of the received signal when the antenna is deliberately mis-pointed by a small amount away from the initial pointing direction in two orthogonal planes. It is possible, by utilization of equations which represent curve fitting to the antenna beam shape in these two orthogonal planes, to estimate the direction of the signal peak relative to the remote receiver, and repoint the antenna toward the remote receiver.

For a transmit/receive antenna system using a common antenna for both transmit and receive, this process will, in addition to more accurately boresighting the transmit beam, automatically also boresight the receive beam. For a transmit/receive antenna system using separate transmit and receive antennas, the receive beam can be more accurately boresighted by "slaving" the receive antenna pointing to the pointing direction of the transmit beam.

This technique is almost invariably applied in the antenna azimuth and elevation planes, i.e., the antenna pointing direction is offset to either side of the initial pointing direction separately in the azimuth and elevation planes, and works well for the great majority of antenna types. There is, however, a class of antennas for which this technique does not work well, and for which, if the step track algorithm is run in the azimuth and elevation planes, will result in errors in the pointing solution derived from the step track process. The class of antennas for which the step track algorithm just described does not work well has two characteristics: the shape of the main beam of the antenna pattern is elliptical rather than circular, and the major and minor axes of the main beam profile ellipse are not generally aligned with the antenna azimuth and elevation planes.

One example of the latter is a smooth-walled conical horn antenna, possibly with an aperture-located phase-correcting lens to reduce the horn flare length. Such a horn normally supports the dominant TE11 waveguide mode, and exhibits the same field distribution in the horn aperture. The impact of this is that the main beam of such antennas is elliptical, with the H-plane 3 dB beamwidth approximately 25% greater than the E-plane beamwidth. Also as the antenna polarization is adjusted to match the polarization orientation of the outgoing wave (the beam rotates about its axis with the plane of polarization, the main beam ellipse will rotate with the plane of polarization, and will not in general align with the antenna azimuth and elevation axes).

These effects are shown graphically in FIG. 1. Polarization is adjusted so that the E-plane 110 is at an angle (the "polarization angle") of 30° to the local vertical. Circle 108 is the elliptical −3 dB contour of the main beam, and lines 102 and 104 are the minor and major axes of the beam ellipse which align with the E-plane 110 and H-plane 112, respectively. As stated earlier, as the antenna polarization is adjusted in real time to match the polarization of the outgoing wave, which will be the case if one or both ends of the communications link are moving, the main beam ellipse will rotate with the polarization.

The deficiencies of the conventional step track algorithm, when applied to the rotated elliptical main beam are shown graphically in FIG. 2. In FIG. 2, azimuth 0° and elevation 0° is defined as the signal peak of the elliptical beam 220. For this example, the initial pointing direction of the antenna (which may be any direction), is the starting point 212 or +1.0° azimuth +1.0° elevation in antenna beam coordinates. This means that the initial pointing direction of the beam signal peak is actually −1.0° azimuth −1.0° elevation relative to the starting point 212. For the conventional step track algorithm, the four offset points 204/206/208/210, from the starting point 212 ($Az_0$,$El_0$) are the following coordinates for antenna pointing:

$$(Az_0+\Delta_{Az},\ El_0)$$

$$(Az_0-\Delta_{Az},\ El_0)$$

$$(Az_0,\ El_0+\Delta_{El})$$

$$(Az_0,\ El_0-\Delta_{El})$$

where $\Delta_{Az}$ and $\Delta_{El}$ are the angular offsets in the azimuth and elevation planes respectively (the amount offset from the starting point 212).

The conventional step track algorithm will first offset the antenna pointing in the azimuth plane to the points 206 and 208 on either side of the starting point 212 on the horizontal dashed line, and based on the relative received signal levels at the starting point 212 and the two points 206/208 on either side, will estimate the location of the beam peak in the azimuth plane (reference number 214) to the left on the horizontal dashed line. The point 214 is estimated as the peak of an inverted parabola, where points 206, 208 and 212 determine the parabola. The same process will then take place in the elevation plane, offsetting the antenna pointing to either side of the starting point 212 to the points 204 and 210 on the vertical dashed line. The points 204, 210 and 212 are used to estimate the location of the beam signal peak in the elevation plane as 216 on the vertical dashed line. For this particular case, the conventional step track algorithm incorrectly estimates the beam peak to be located at point 218 (0.12°, 0.16°); whereas the beam signal peak is actually located at point 220 (0°,0°).

The error occurs because the conventional step track algorithm does not correctly compensate for the angular offsets inherent in an elliptical beam that are not present in a circular beam. FIG. 3 shows how the magnitude of the step track elevation error 302 and azimuth error 304 are linearly related to the magnitude of the initial azimuth and elevation offsets to the pointing direction for peak beam power. FIG. 4 shows the dependence of the step track elevation error 404 and azimuth error 402 on the polarization angle, with an initial pointing direction (starting point) (see FIG. 2, reference number 212) at (1.0°, 1.0°). When the polarization angle is either 0° (vertical polarization), or 90° (horizontal polarization), the step track errors become zero, since for those cases the principal axes of the main beam ellipse are aligned with the antenna azimuth and elevation axes. For all other polarization angles, the step track errors are greater than zero.

An existing method of reducing the step track pointing solution errors induced by application of the conventional step track algorithm to a rotated elliptical beam is to apply the conventional algorithm iteratively. Simulation has shown that this will provide a convergent solution, however several iterations are required, and the time taken to derive an acceptably accurate pointing solution will be excessive.

SUMMARY

A system and methods to align an elliptical beam of an antenna to a line-of-sight from the antenna to a remote receiver are disclosed. In one embodiment, the method offsets the antenna from an initial pointing direction (starting point) to two pointing offsets $\pm\Delta_E$ in the E-plane and two pointing offsets $\pm\Delta_H$ in the H-plane of the antenna beam coordinate system. Coordinates of the pointing offsets are then transferred/converted from the E-plane and the H-plane into corresponding offset points in an azimuth plane and elevation plane of an antenna pointing coordinate system. The antenna is then pointed in the direction of each of the offset points in the antenna pointing coordinate system and a received signal strength is measured at each of the offset points and at the starting point. The method performs a tracking algorithm using received signal strength data at the starting point and the four offset points to calculate the true location of a peak/center of the elliptical beam relative to the antenna pointing coordinate system.

The conditions for which the system and methods can be usefully applied are a) that the satcom or other terminal antenna has a main beam which is elliptical in cross-section, b) that the link is linearly (as opposed to circularly) polarized and c) that the major axis of the ellipse is rotated with the plane of polarization. The main application for the disclosure will be as part of a satcom terminal, aligning the antenna beam with the line-of-sight from the terminal to the satellite. It would, however, also be applicable to other forms of microwave communications link, for example from a fixed ground terminal to a UAV, to accurately track the movement of the UAV.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of embodiments of the disclosure may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the disclosure or the application and uses of such embodiments. Furthermore, there is no intention to be bound by any expressed or implied theory presented in the preceding technical field, background, brief summary or the following detailed description.

Embodiments of the disclosure may be described herein in terms of functional and/or logical block components and various processing steps. It should be appreciated that such block components may be realized by any number of hardware, software, and/or firmware components configured to perform the specified functions. For example, an embodiment may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the disclosure may be practiced in conjunction with a variety of different antenna systems and antenna configurations, and that the system described herein is merely one example embodiment of the disclosure.

For the sake of brevity, conventional techniques and components related to signal processing, antenna tracking systems, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the disclosure.

Figure 5:
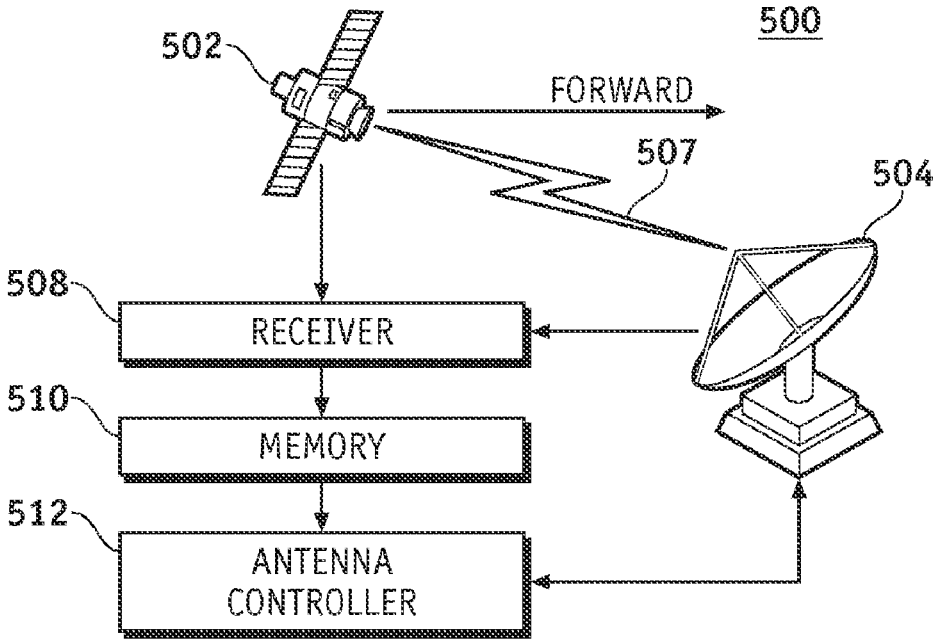
FIG. 5 is a schematic representation of an elliptical beam antenna pointing system.

The following description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIG. 5 depicts example arrangements of elements, additional intervening elements, devices, features, or components may be present in an embodiment of the disclosure. A practical system 500 may include a number of electrical control units (ECUs), communication systems, onboard computer systems, measurement architectures, networks and components other than those shown in FIG. 5. Conventional subsystems, features, and aspects of system 500 will not be described in detail herein.

FIG. 5 is a schematic representation of an example embodiment of an elliptical beam antenna pointing system 500. For this example embodiment, system 500 generally includes: an antenna 504 in communication with a remote transceiver 502, a receiver 508, a memory module 510, and an antenna controller 512. In practice, these elements may be coupled together using any suitable interconnection architecture or arrangement.

Antenna 504 may be configured to track the remote transceiver 502 using an elliptical beam pattern. The antenna 504 delivers electromagnetic signals 507 to the remote transceiver 502. The antenna 504 may be, without limitation, a smooth walled conical horn, a smooth walled conical horn with a phase correcting horn in the aperture (to reduce the horn length), and a symmetric parabolic reflector antenna with a feed whose beam widths are substantially different between the E and H planes.

Receiver 508 is coupled to the remote transceiver 502 and is configured to receive measured properties of the electromagnetic signals 507 delivered by the antenna 504. In practice, the receiver 508 will amplify, filter and in some cases demodulate the received signal delivered by the antenna 504, producing an RSSI output which is a measure of the received signal strength. The measured properties of the electromagnetic signals 507 may be, without limitation, received signal strength indicators (RSSIs) corresponding to different points of interest, different alignment/pointing conditions, or the like.

Memory module 510 may be any suitable data storage area with suitable amount of memory that is formatted to support the operation of the system 500. Memory module 510 is configured to store, maintain, and provide data as needed to support the functionality of the system 500 in the manner described below. In practical embodiments, memory module 510 may be realized as RAM memory, flash memory, ROM memory, EPROM memory, EEPROM memory, registers, a hard disk, a removable disk, or any other form of storage medium known in the art. The memory module 510 may be coupled to the antenna controller 512 and configured to store, without limitation, measured properties of the received electromagnetic signals, measurement data values corresponding to the antenna position, the remote transceiver 502 positions and velocity, RSSI outputs of the receiver 508, the offset points, the starting point, and the polarization angle of the elliptical beam of the antenna. The RSSI output is read by the antenna controller 512 at each of the five pointing directions (offset points and the starting point).

The antenna controller 512 is coupled to the memory 510 and is configured to command the antenna 504 to change its pointing directions to implement the step track algorithm via a motor drive interfaced with the antenna 504 (not shown in FIG. 5) and to monitor the actual pointing direction via an angle encoder interfaced with the antenna 504 (not shown in FIG. 5). The antenna controller 512 may include any number of distinct processing modules, searchers, trackers, or components that are configured to perform the tasks, processes, and operations described in more detail herein. Although only one processing block is shown in FIG. 5, a practical implementation may utilize any number of distinct physical and/or logical processors, which may be dispersed throughout system 500. In practice, the antenna controller 512 may be implemented or performed with a general purpose processor, a content addressable memory, a digital signal processor, an application specific integrated circuit, a field programmable gate array, any suitable programmable logic device, discrete gate or transistor logic, discrete hardware components, or any combination thereof, designed to perform the functions described herein. A processor may be realized as a microprocessor, a controller, a microcontroller, or a state machine. A processor may also be implemented as a combination of computing devices, e.g., a combination of a digital signal processor and a microprocessor, a plurality of microprocessors, one or more microprocessors in conjunction with a digital signal processor core, or any other such configuration.

In summary, the receiver 508 will amplify, filter and in some cases demodulate the received signal delivered by the antenna 504, producing an RSSI output which is a measure of the received signal strength. The RSSI output is read by the antenna controller 512 at each of the five pointing directions (the offset points and the starting point). The antenna controller 512 computes the step track solution and will command the antenna 504 to change its pointing directions to this new pointing direction as explained in detailed below.

Figure 6:
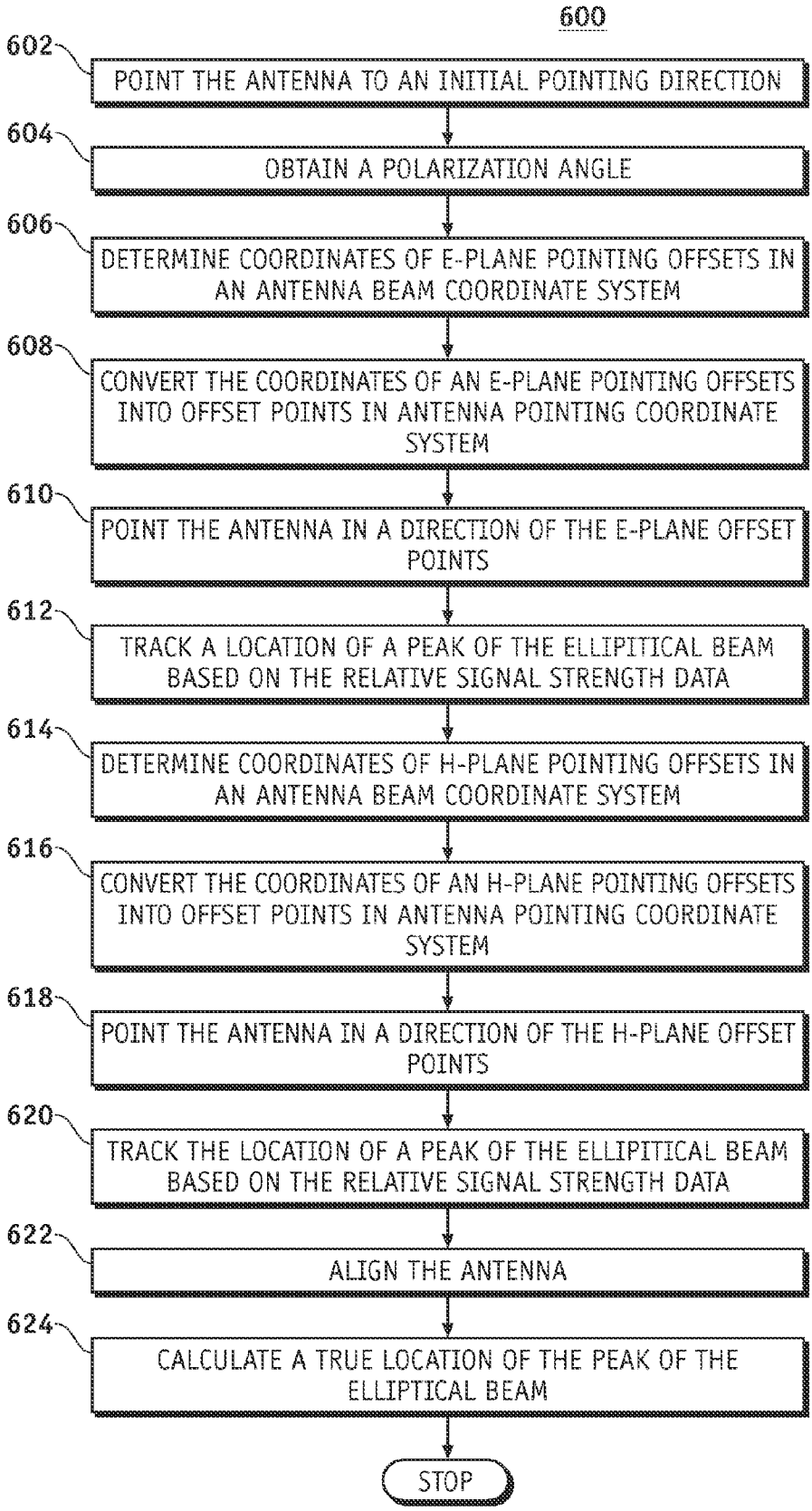
FIG. 6 is a flow chart that illustrates an elliptical beam antenna alignment process.

FIG. 6 is a flow chart that illustrates an elliptical beam pointing/alignment process 600 suitable for use in connection with an elliptical beam pointing system 500. The various tasks performed in connection with process 600 may be performed by software, hardware, firmware, or any combination thereof. For illustrative purposes, the following description of process 600 may refer to elements mentioned above in connection with FIG. 5. In an embodiment, portions of process 600 may be performed by different elements of the system 500, e.g., the antenna, the receiver, the memory module, the antenna controller, or the like. It should be appreciated that process 600 may include any number of additional or alternative tasks, the tasks shown in FIG. 6 need not be performed in the illustrated order, and process 600 may be incorporated into a more comprehensive procedure or process having additional functionality not described in detail herein.

Process 600 may be utilized to align a peak of an elliptical beam of an antenna to a line-of-sight from the antenna to a remote transmitter. Process 600 begins with the antenna being pointed to an initial pointing direction in an antenna pointing coordinate system (task 602). The antenna pointing coordinate system has azimuth plane and elevation plane coordinates, and the initial pointing direction/starting point is defined in terms of such coordinates. In practice, the initial pointing direction is the direction in which the antenna happened to be pointing prior to the initiation of process 600. Process 600 then proceeds to determine coordinates of pointing offsets $\pm\Delta_E$ and $\pm\Delta_H$ in an antenna beam coordinate system and convert these offset points into azimuth and elevation coordinates located in the antenna pointing coordinate system. The antenna beam coordinate system has an E-plane, and an H-plane. For a linearly polarized antenna, the E-plane is the plane containing the electric field vector and the direction of maximum radiation. The electric field or E-plane determines the polarization or orientation of the radio wave. For a vertically polarized antenna, the E-plane may coincide with the vertical/elevation plane. For a horizontally-polarized antenna, the E-plane may coincide with the horizontal/azimuth plane. In the case of a linearly polarized antenna, an H-plane is the plane containing the magnetic field vector and the direction of maximum radiation. The magnetic field or H-plane lies at a right angle to the E-plane. For a vertically polarized antenna, the H-plane may coincide with the horizontal/azimuth plane. For a horizontally-polarized antenna, the H-plane may coincide with the vertical/elevation plane.

Thus, process 600 obtains the polarization angle/polarization angle of the E-plane (task 604) and determines coordinates of E-plane pointing offsets $\pm\Delta_E$ in the antenna beam coordinate system relative to the initial pointing direction (task 606). To obtain a location of the E-plane pointing offsets in the antenna pointing coordinate system, process 600 then converts/transfers the coordinates of the E-plane pointing offsets $\pm\Delta_E$ from the antenna beam coordinate system into the antenna pointing coordinate system using the polarization angle. In this regard, coordinates of the E-plane pointing offsets $\pm\Delta_E$ are converted from the antenna beam coordinate system into two E-plane offset points located in the antenna pointing coordinate system (task 608) at the following azimuth/elevation coordinates:

$$(Az_0+\Delta_E \sin\psi,\ El_0+\Delta_E \cos\omega) \quad (1)$$

$$(Az_0-\Delta_E \sin\omega,\ El_0-\Delta_E \cos\psi) \quad (2)$$

where $Az_0$ is the azimuth plane coordinate of the initial pointing direction, $El_0$ is the elevation plane coordinate of initial pointing direction, $\Delta_E$ is the E-plane pointing offset in the antenna beam coordinate system, and $\psi$ is the polarization angle. The elliptical beam antenna is then pointed in the direction of each of the two E-plane offset points (converted based on the coordinate relationships 1 and 2 above) in the antenna pointing coordinate system (task 610). The received signal strength is then measured at each of the two E-plane offset points (having already been measured at the starting point) and a location of a peak of the elliptical beam is tracked/obtained based on relative signal strengths data measured at the E-plane offset points and measured at the initial pointing direction (task 612). Process 600 utilizes a tracking algorithm to estimate the location of the peak of the elliptical beam. The tracking algorithm will first determine the relative signal strength at the two E-plane offset points and the initial/starting pointing direction, and if the elliptical beam antenna is correctly pointed/aligned, then the relative signal strengths from the initial/starting pointing direction will be identical at both E-plane offset points. If the antenna boresight is not aligned with the signal source then the relative signal strengths from the initial/starting pointing direction will not be identical at both E-plane offset points. In this regard, information (i.e., power level at each offset point) to properly align the antenna boresight will be provided to the tracking algorithm to align the antenna. In practice, the antenna will dwell at each of the initial pointing directions ($Az_0$,$El_0$) and the E-plane offset points in order to improve the signal to noise ratio of the RSSI value by a process of integration or averaging. The location of the elliptical beam peak may, without limitation, be estimated as the peak of an inverted parabola where the starting point and the E-plane offset points determine the parabola (ellipsoids or other curve fits may be used).

Process 600 then proceeds to determine coordinates of the H-plane pointing offsets $\pm\Delta_H$ in the antenna beam coordinate system relative to the initial pointing direction (task 614). To obtain location of the H-plane pointing offsets in the antenna pointing coordinate system, process 600 then converts the coordinates of the H-plane pointing offsets $\pm\Delta_H$ from the antenna beam coordinate system to the antenna pointing coordinate system using the polarization angle (task 616). In this regard, coordinates of the H-plane pointing offsets $\pm\Delta_H$ are converted from the antenna beam coordinate system into two H-plan offset points located in the antenna pointing coordinate system at the following azimuth/elevation coordinates:

$$(Az_0+\Delta_H \cos\psi,\ El_0-\Delta_H \sin\psi) \quad (3)$$

$$(Az_0-\Delta_H \cos\psi,\ El_0+\Delta_H \sin\psi) \quad (4)$$

where $Az_0$, $El_0$ and $\psi$ are as explained above, and $\Delta_H$ is the H-plane pointing offset in the antenna beam coordinate system. The elliptical beam antenna is then pointed in the direction of each of the two H-plane offset points (converted based on the coordinate relationships 2 and 3) in the antenna pointing coordinate system (task 618). The received signal strength is then measured at each of the two H-plane offset points (having already been measured at the starting point) and the location of the peak of the elliptical beam is tracked/obtained based on relative signal strengths measured at the H-plane offset points and measured at the initial pointing direction (task 620). A tracking algorithm (as explained above in the context of the E-plane offset points) is utilized to track the location of the peak of the elliptical beam based on relative signal strengths measured at the H-plane offset points. In this regard, the tracking algorithm determines the relative signal strength at the two H-plane offset points and the initial/starting pointing direction, and if the elliptical beam antenna is correctly pointed/aligned, then the relative signal strengths from the initial/starting pointing direction will be identical at both H-plane offset points. If the antenna boresight is not aligned with the signal source then the relative signal strengths from the initial/starting pointing direction will not be identical at both H-plane offset points. In this regard, information (i.e. power level at each offset point) to properly align the antenna boresight will be provided to the tracking algorithm to align the antenna. In practice, the antenna will dwell at each of the initial pointing directions ($Az_0$,$El_0$) and the H-plane offset points in order to improve the signal to noise ratio of the RSSI value by a process of integration or averaging. The location of the elliptical beam peak may, without limitation, be estimated as the peak of an inverted parabola where the starting point and the H-plane offset points determine the parabola (ellipsoids or other curve fits may be used).

Figure 7:
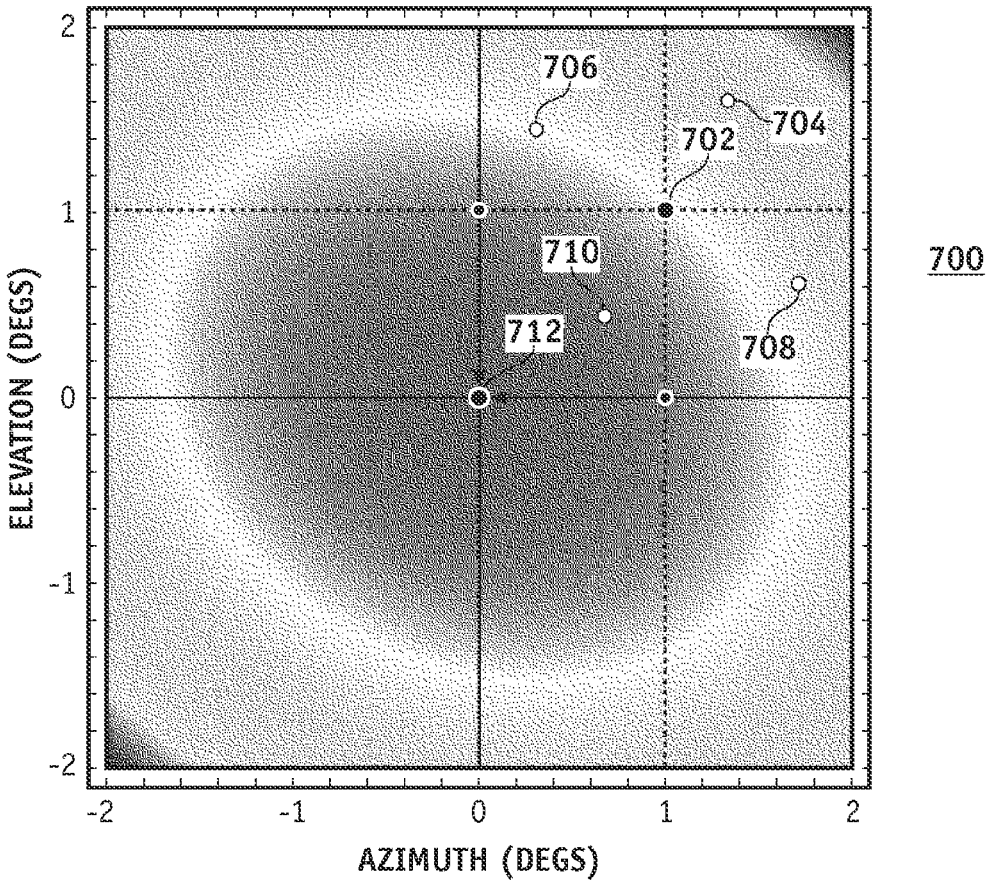
FIG. 7 is a diagram that graphically illustrates the performance of a modified step track algorithm for a rotated elliptical beam.

Process 600 then aligns the antenna boresight to a direction corresponding to the peak of the elliptical beam (task 622). In this regard, the antenna controller commands the antenna to change its pointing direction to the peak of the elliptical beam via a motor drive interface and monitors the actual pointing direction via an angle encoder interface. FIG. 7 graphically illustrates the four offset points 704/706/708/710 around the initial pointing direction (starting point) 702. Process 600 will estimate the location of the beam peak in the antenna E-plane based on the relative received signal levels at the initial pointing direction 702 and the two E-plane offset points 704/710. The same process will then take place in the antenna H-plane for estimating the location of beam peak in the H-plane based on the relative signal levels at the initial pointing direction 702 and the two offset points 706/708.

Process 600 proceeds by calculating the true location of the center of the elliptical beam in the azimuth/elevation coordinates of the antenna pointing coordinate system (task 624). In this regard, if the initial pointing direction in the antenna pointing coordinate system (azimuth/elevation coordinates) is ($Az_0$,$El_0$) and the peaks of the main beam pattern cuts in the E and H planes respectively are found to be offset from the initial pointing direction in these planes by $\epsilon_E$ and $\epsilon_H$ respectively, then the step track solution, i.e. the true direction/location of the beam peak in antenna azimuth/elevation planes coordinates, is given by the following relationship:

$$Az=Az_0+\epsilon_E \sin\psi+\epsilon_H \cos\psi$$

$$El=El_0+\epsilon_E \cos\psi-\epsilon_H \sin\psi$$

where, Az is the true direction of the beam peak in antenna azimuth plane coordinate, El is the true direction of the beam peak in antenna elevation plane coordinate; $El_0$, $Az_0$ and $\psi$ are explained above.

Figure 1:
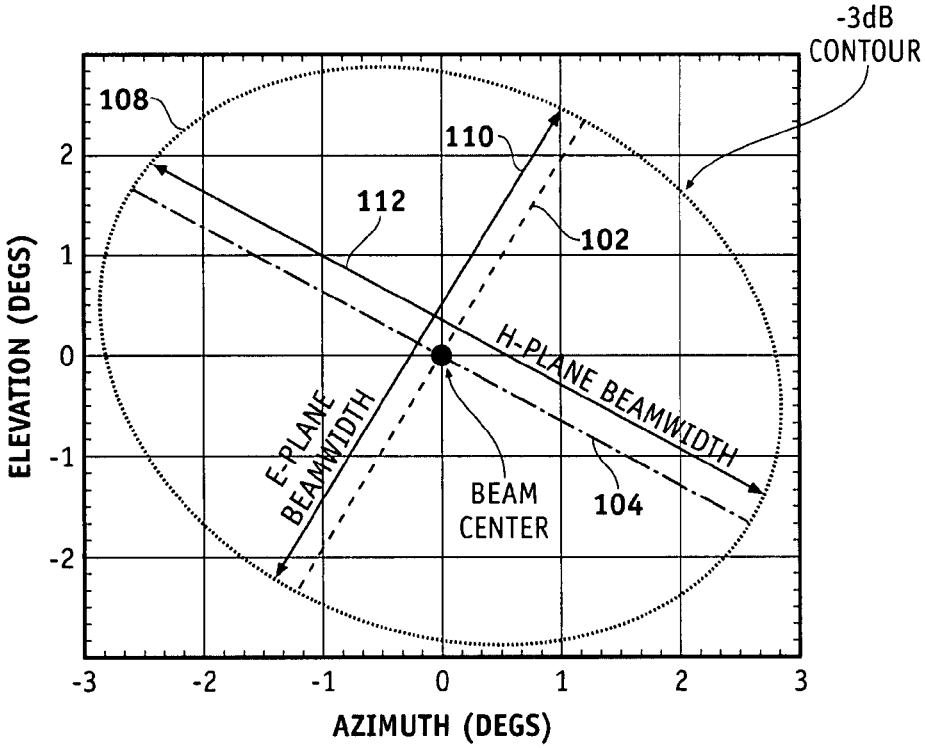
FIG. 1 is a diagram that illustrates a rotated elliptical beam.
Figure 2:
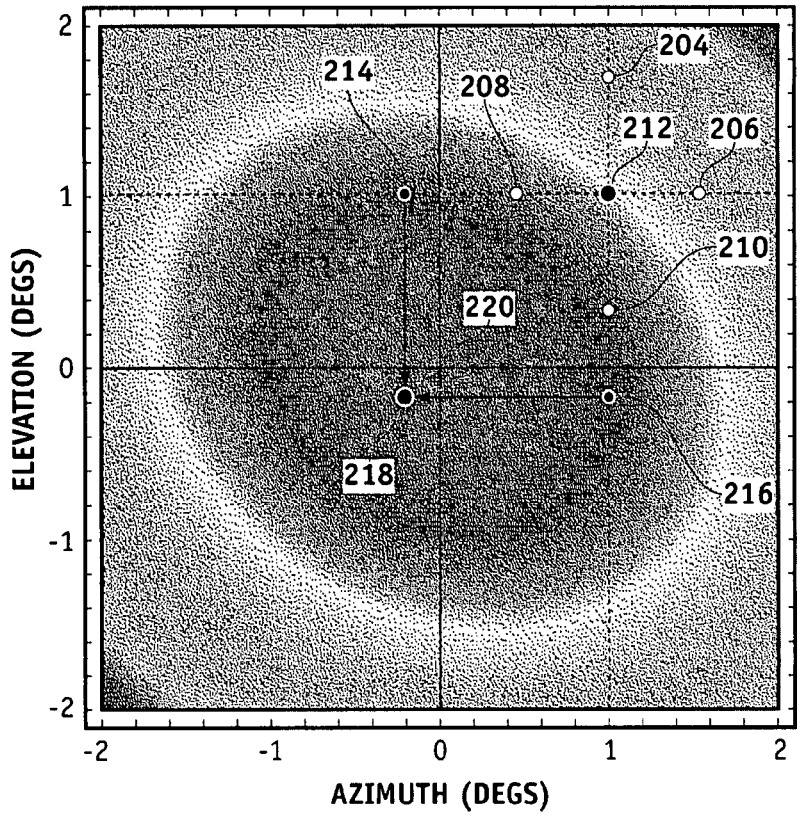
FIG. 2 (PRIOR ART)
FIG. 2 is a diagram that graphically illustrates a conventional step track solution with a rotated elliptical beam.
Figure 3:
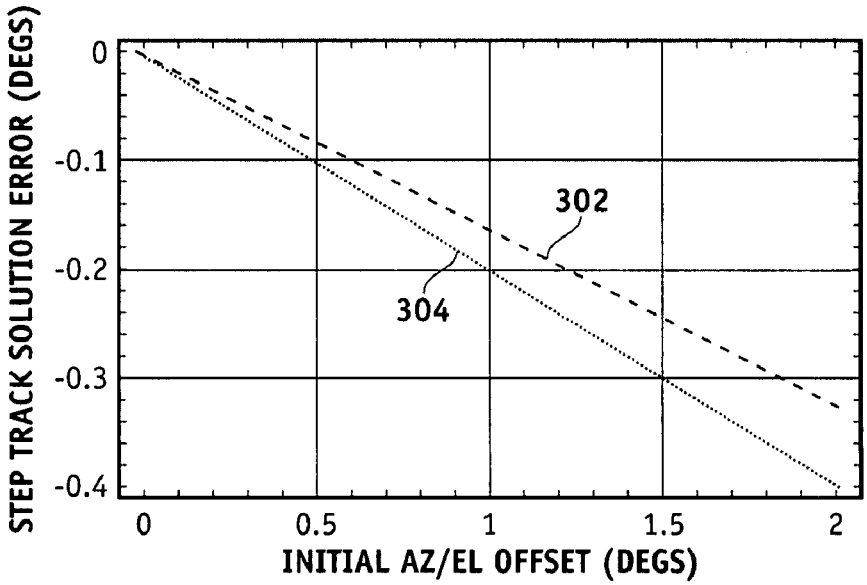
FIG. 3 (PRIOR ART)
FIG. 3 is a diagram that graphically illustrates a conventional step track solution error versus pointing offsets.
Figure 4:
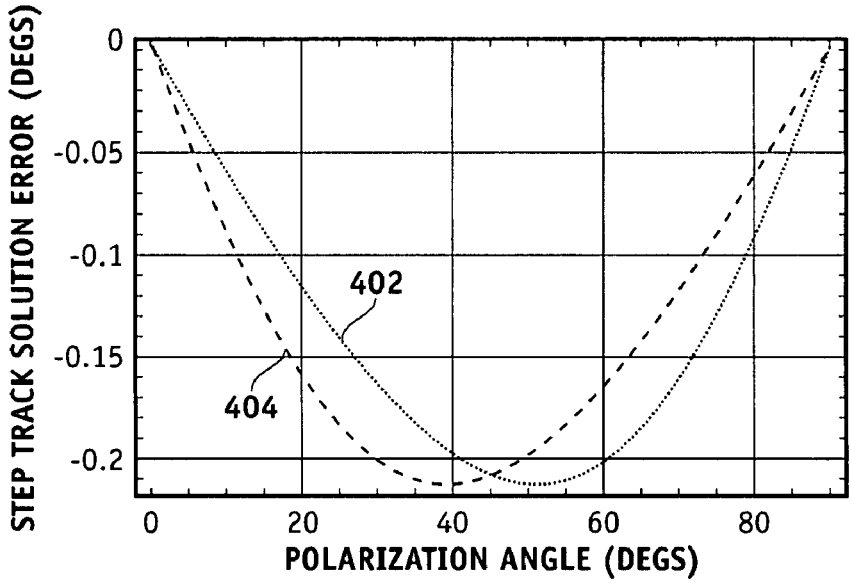
FIG. 4 (PRIOR ART)
FIG. 4 is a diagram that graphically illustrates a conventional step track solution error versus polarization angle.

FIG. 7 graphically illustrates performance of the modified step track algorithm and should be compared with FIG. 2, which depicts the operation of the conventional step track. FIG. 7 graphically illustrates the four offset points 704/706/708/710 around the initial pointing direction (starting point) 702, and it is apparent that the offsets are now applied in the E and H planes rather than the azimuth and elevation planes. It is also apparent from FIG. 7 that the elliptical beam peak location 712 in both the azimuth and elevation planes is correctly estimated, and the (0°,0°) pointing solution is obtained.

In summary, elliptical beam antenna pointing methods as described herein comprise: pointing the elliptical beam of an antenna toward an initial pointing direction (starting point); determining coordinates of E-plane pointing offsets and H-plane pointing offsets in the antenna beam coordinate system (E-H planes) relative to the starting point; converting the coordinates of the E-plane and the H-plane pointing offsets from the antenna beam coordinate system to coordinates of offset points each located in the antenna pointing coordinate system (azimuth/elevation planes) using the polarization angle; tracking center/peak of elliptical beam based on received signal strength data measured at the offset points and measured at the initial pointing direction; and calculating the true location of a center/peak of the elliptical beam relative to the antenna pointing coordinate system (azimuth/elevation planes). With this approach, pointing errors that result from applying the conventional step-track algorithm to a rotated elliptical beam are avoided.

While at least one example embodiment has been presented in the foregoing detailed description, it should be appreciated that a vast number of variations exist. It should also be appreciated that the example embodiment or embodiments described herein are not intended to limit the scope, applicability, or configuration of subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A method for aligning an elliptical beam of an antenna, having an antenna beam coordinate system, the method comprising:

pointing the antenna to an initial pointing direction, wherein the initial pointing direction has coordinates in an antenna pointing coordinate system that includes an azimuth plane coordinate and an elevation plane coordinate;

determining coordinates of E-plane pointing offsets relative to the initial pointing direction, wherein the coordinates of the E-plane pointing offsets are located in an E-plane of the antenna beam coordinate system;

converting the coordinates of the E-plane pointing offsets from the antenna beam coordinate system into a first E-plane offset point and a second E-plane offset point, wherein each E-plane offset point is located in the antenna pointing coordinate system;

determining coordinates of H-plane pointing offsets relative to the initial pointing direction, wherein the coordinates of the H-plane pointing offsets are located in an H-plane of the antenna beam coordinate system;

converting the coordinates of the H-plane pointing offsets from the antenna beam coordinate system into a first H-plane offset point and a second H-plane offset point, wherein each H-plane offset point is located in the antenna pointing coordinate system; and calculating a true location of a peak of the elliptical beam in coordinates of the antenna pointing coordinate system.

2. A method according to claim 1, wherein the first E-plane offset point is located in the antenna pointing coordinate system at ($Az_0+\Delta_E \sin\psi$, $El_0\pm\Delta_E \cos\psi$), where $Az_0$ is the azimuth plane coordinate of the initial pointing direction, $El_0$ is the elevation plane coordinate of the initial pointing direction, $\Delta_E$ is the E-plane pointing offset in the antenna beam coordinate system, and $\psi$ is the polarization angle.

3. A method according to claim 1, wherein the second E-plane offset point is located in the antenna pointing coordinate system at ($Az_0-\Delta_E \sin\psi$, $El_0-\Delta_E \cos\psi$), where $Az_0$ is the azimuth plane coordinate of the initial pointing direction, $El_0$ is the elevation plane coordinate of the initial pointing direction, $\Delta_E$ is the E-plane pointing offset in the antenna beam coordinate system, and $\psi$ is the polarization angle.

4. A method according to claim 1, wherein the first H-plane offset point is located in the antenna pointing coordinate system at ($Az_0+\Delta_H \cos\psi$, $El_0-\Delta_H \sin\psi$), where $Az_0$ is the azimuth plane coordinate of the initial pointing direction, $El_0$ is the elevation plane coordinate of the initial pointing direction, $\Delta_H$ is the H-plane pointing offset in the antenna beam coordinate system, and $\psi$ is the polarization angle.

5. A method according to claim 1, wherein the second H-plane offset point is located in the antenna pointing coordinate system at ($Az_0-\Delta_H \cos\psi$, $El_0+\Delta_H \sin\psi$), where $Az_0$ is the azimuth plane coordinate of the initial pointing direction, $El_0$ is the elevation plane coordinate of the initial pointing direction, $\Delta_H$ is the H-plane pointing offset in the antenna beam coordinate system, and $\psi$ is the polarization angle.

6. A method according to claim 1, further comprising:

tracking a location of the peak of the elliptical beam based on relative signal strengths measured at the E-plane offset points and measured at the initial pointing direction;

tracking the location of the peak of the elliptical beam based on relative signal strengths measured at the H-plane offset points;

aligning the antenna to a direction corresponding to the peak of the elliptical beam in the antenna pointing coordinate system.

7. A method according to claim 1, wherein the true location of the peak of the elliptical beam is based on the relationships:

$$Az=Az_0+\epsilon_E \sin\psi+\epsilon_H \cos\psi; \text{ and}$$

$El=El_0+\epsilon_E \cos\psi-\epsilon_H \sin\psi$; where Az is true direction of the peak of the elliptical beam in the azimuth plane coordinate, El is true direction of the peak of the elliptical beam in the elevation plane coordinate, $Az_0$ is the azimuth plane coordinate of the initial pointing direction, $El_0$ is the elevation plane coordinate of the initial pointing direction, $\epsilon_E$ is an offset of the peak of the elliptical beam from the initial pointing direction in the E-plane; $\epsilon_H$ is an offset of the peak of the elliptical beam from the initial pointing direction in the H-plane, and $\psi$ is the polarization angle.

8. A method for pointing an elliptical beam of an antenna having an antenna beam coordinate system, the method comprising:

pointing the antenna to an initial pointing direction, wherein the initial pointing direction has coordinates in an antenna pointing coordinate system;

determining coordinates of pointing offsets in the antenna beam coordinate system;

converting the coordinates of the pointing offsets from the antenna beam coordinate system into coordinates of offset points each located in the antenna pointing coordinate system; and calculating a true location of a peak of the elliptical beam in coordinates of the antenna pointing coordinate system.

9. A method according to claim 8, wherein the converting step further comprises:

obtaining a polarization angle of the antenna beam coordinate system; and obtaining the coordinates of the offset points in the antenna pointing coordinate system using the polarization angle.

10. A method according to claim 9, wherein the obtaining step locates the offset points in the antenna pointing coordinate system at:

$$(Az_0+\Delta_E \sin \psi, El_0+\Delta_E \cos \psi);$$

$$(Az_0-\Delta_E \sin, El_0-\Delta_E \cos \psi);$$

$$(Az_0+\Delta_H \cos \psi, El_0-\Delta_H \sin \psi); \text{ and}$$

$(Az_0-\Delta_H \cos \psi, El_0+\Delta_H \sin \psi)$, where $Az_0$ is an azimuth plane coordinate of the initial pointing direction, $El_0$ is an elevation plane coordinate of the initial pointing direction, $\Delta_H$ is an H-plane offset point in the antenna beam coordinate system, $\Delta_E$ is an E-plane offset point in the antenna beam coordinate system, and $\psi$ is the polarization angle.

11. A method according to claim 8, wherein the antenna pointing coordinate system comprises an azimuth plane coordinate and an elevation plane coordinate.

12. A method according to claim 11, wherein the true location of the peak of the elliptical beam in the antenna pointing coordinate system is located at:

$$Az=Az_0+\epsilon_E \sin \psi+\epsilon_H \cos \psi; \text{ and}$$

$El=El_0+\epsilon_E \cos \psi-\epsilon_H \sin \psi$; where Az is true direction of the peak of the elliptical beam in the azimuth plane coordinate, El is true direction of the peak of the elliptical beam in the elevation plane coordinate, $Az_0$ is an azimuth plane coordinate of the initial pointing direction, $El_0$ is an elevation plane coordinate of the initial pointing direction, $\epsilon_E$ is an offset of the peak of the elliptical beam from the initial pointing direction in an E-plane; $\epsilon_H$ is an offset of the peak of the elliptical beam from the initial pointing direction in an H-plane, and $\psi$ is the polarization angle.

13. A method according to claim 8, wherein the antenna beam coordinate system comprises an antenna E-plane, and an antenna H-plane.

14. A method according to claim 8, further comprising tracking the peak of the elliptical beam based on relative signal strengths measured at the offset points and measured at the initial pointing direction.

15. A system for aligning an elliptical beam of an antenna to a line-of-sight of a remote transceiver, wherein the antenna has an initial pointing direction, the system comprising:

a receiver coupled to the remote transceiver and configured to measure properties of received electromagnetic signals, wherein the received electromagnetic signals are delivered by the antenna; and an antenna controller coupled to the receiver and configured to:

determine coordinates of E-plane pointing offsets relative to the initial pointing direction, wherein the coordinates of the E-plane pointing offsets are located in an E-plane of the antenna beam coordinate system;

convert the coordinates of the E-plane pointing offsets from the antenna beam coordinate system into a first E-plane offset point and a second E-plane offset point, wherein each E-plane offset point is located in the antenna pointing coordinate system;

determine coordinates of H-plane pointing offsets relative to the initial pointing direction, wherein the coordinates of the H-plane pointing offsets are located in an H-plane of the antenna beam coordinate system;

convert the coordinates of the H-plane pointing offsets from the antenna beam coordinate system into a first H-plane offset point and a second H-plane offset point, wherein each H-plane offset point is located in the antenna pointing coordinate system; and calculate a true location of a peak of the elliptical beam in coordinates of the antenna pointing coordinate system.

16. A system according to claim 15, further comprising a memory module coupled to the receiver and configured to store measured properties of the received electromagnetic signals.

17. A system according to claim 15, wherein the measured properties of received electromagnetic signals comprise:

a measured relative received signal strength at the initial pointing direction;

measured relative received signal strengths at the H-plane offset points; and measured relative signal strengths at the E-plane offset points.

18. A system according to claim 15, wherein the antenna pointing coordinate system comprises an azimuth plane coordinate and an elevation plane coordinate.

19. A system according to claim 18, wherein the true location of the peak of elliptical beam is located in the azimuth plane and the elevation plane coordinates.

20. A system according to claim 15, wherein the antenna controller is further configured to:

track a location of a peak of the elliptical beam based on relative signal strengths measured at the E-plane offset points and measured at the initial pointing direction;

track the location of the peak of the elliptical beam based on relative signal strengths measured at the H-plane offset points; and align the antenna to a direction corresponding to the location of the peak of the elliptical beam in the antenna pointing coordinate system.

* * * * *